US011291609B2

(12) United States Patent
Lee et al.

(10) Patent No.: US 11,291,609 B2
(45) Date of Patent: Apr. 5, 2022

(54) SOFT CAPSULE MANUFACTURING APPARATUS FOR CONTROLLING THE INJECTION OF CORE SOLUTION

(71) Applicants: Wan Kyun Lee, Gyeonggi-do (KR); Geum Duk Park, Seoul (KR)

(72) Inventors: Wan Kyun Lee, Gyeonggi-do (KR); Geum Duk Park, Seoul (KR)

( * ) Notice: Subject to any disclaimer, the term of this patent is extended or adjusted under 35 U.S.C. 154(b) by 195 days.

(21) Appl. No.: 16/734,053

(22) Filed: Jan. 3, 2020

(65) Prior Publication Data

US 2021/0113434 A1 Apr. 22, 2021

(30) Foreign Application Priority Data

Oct. 22, 2019 (KR) ..... 10-2019-0131117

(51) Int. Cl.

| | |
|---|---|
| ***A61J 3/07*** | (2006.01) |
| ***B65B 3/00*** | (2006.01) |
| ***B65B 3/02*** | (2006.01) |
| ***B65B 3/04*** | (2006.01) |
| ***B65B 3/26*** | (2006.01) |
| ***B65B 37/06*** | (2006.01) |
| ***B65B 39/00*** | (2006.01) |
| ***B65B 57/10*** | (2006.01) |

(52) U.S. Cl.

CPC ..... *A61J 3/07* (2013.01); *B65B 3/003* (2013.01); *B65B 3/02* (2013.01); *B65B 3/04* (2013.01); *B65B 3/26* (2013.01); *B65B 37/06* (2013.01); *B65B 39/001* (2013.01); *B65B 57/10* (2013.01)

(58) Field of Classification Search

None

See application file for complete search history.

(56) References Cited

U.S. PATENT DOCUMENTS

| | | | | |
|---|---|---|---|---|
| 1,970,396 | A * | 8/1934 | Scherer | A61J 3/07 53/451 |
| 2,356,436 | A * | 8/1944 | Scherer | A61J 3/07 417/517 |
| 2,387,747 | A * | 10/1945 | Cowley | A61J 3/07 53/454 |
| 2,431,141 | A * | 11/1947 | Scherer | A61J 3/07 53/560 |
| 2,838,795 | A * | 6/1958 | Lockwood | B01J 20/0288 53/454 |
| 5,761,886 | A * | 6/1998 | Parkhideh | A61J 3/07 53/140 |
| 6,238,616 | B1 * | 5/2001 | Ishikawa | A61J 3/07 264/553 |
| 7,036,291 | B1 * | 5/2006 | Stark | B65B 9/042 53/454 |

(Continued)

FOREIGN PATENT DOCUMENTS

KR 101074483 B1 10/2011

*Primary Examiner* — Hemant Desai

*Assistant Examiner* — Tanzim Imam

(74) *Attorney, Agent, or Firm* — MH2 Technology Law Group, LLP

(57) ABSTRACT

A soft capsule manufacturing apparatus for controlling an injection amount, an injection interval and/or an injection rate of core solution by an injection controller, wherein the operation of the injection controller is automatically adjusted and controlled by a control panel, after processing the signal from the detection sensor for checking the injection status.

5 Claims, 9 Drawing Sheets

(56) References Cited

U.S. PATENT DOCUMENTS

| | | | | |
|---|---|---|---|---|
| 2003/0084641 | A1* | 5/2003 | Tanner | B29C 48/305 53/140 |
| 2005/0073066 | A1* | 4/2005 | Victorov | B65B 57/00 264/40.1 |
| 2010/0018170 | A1* | 1/2010 | Oana | A61J 3/07 53/560 |
| 2012/0128765 | A1* | 5/2012 | Brocker | A61K 9/4858 424/451 |
| 2014/0353881 | A1* | 12/2014 | Salazar Altamar | A61J 3/074 264/464 |
| 2017/0049707 | A1* | 2/2017 | Yang | A61K 9/4808 |
| 2017/0239142 | A1* | 8/2017 | Fulper | A61K 9/4866 |

* cited by examiner

SOFT CAPSULE MANUFACTURING APPARATUS FOR CONTROLLING THE INJECTION OF CORE SOLUTION

CROSS-REFERENCE TO RELATED APPLICATIONS

This application claims priority to Korean Application No. 10-2019-0131117 filed on 22 Oct. 2019, the entire disclosure of which is hereby incorporated by reference in its entirety.

TECHNICAL FIELD

The present invention relates to a soft capsule manufacturing apparatus for controlling the injection of core solution. More specifically, the present invention relates to a soft capsule manufacturing apparatus for controlling an injection amount, an injection interval and/or an injection rate of core solution by injection controller, wherein the operation of injection controller is automatically adjusted and controlled by control panel, after processing the signal from the detection sensor for checking the injection status.

DESCRIPTION OF PRIOR ART

Soft capsule manufacturing apparatus has been applied for manufacturing a variety of gelatin soft capsules for conveniently administering the liquid type of medicine or health functional ingredient.

In the conventional soft capsule manufacturing apparatus, the melted gelatin is discharged from the spreader box. After supplying it into the cooling drum, a gelatin sheet is continuously formed. Then, both gelatin sheets from left and right cooling drums are transferred through a plurality of transfer rollers into the bottom of injection wedge segment, where the bottom of injection wedge segment and the surfaces of two die rolls are crossly intersected.

On the other hand, the core solution supplied from the hopper is transferred into the nozzle of the injection wedge segment and it is encapsulated by the gelatin sheet at the bottom of injection wedge segment. However, the uniformed amount of core solution from the nozzle of the injection wedge segment may not be easily achieved, because it requires a precise rotation and operation of the two die rolls as well as a precise injection of core solution.

Therefore, the development of highly sophisticated soft capsule manufacturing apparatus has been required for manufacturing a soft capsule with a specific uniformed amount of core solution at a constant rate.

In Korean Patent No. 10-1074483 'Drug injection control device and soft capsule manufacturing apparatus comprising the same', a drug injection device equipped with a piston unit has been developed for injecting the drug at the wedge segment. In this device, the amount of discharged drug can be also determined by adjusting the moving distance of the piston unit.

However, in this patent disclosure, it merely disclosed the adjustment and control of the injection amount of the drug using the piston according to the left and right movement without any control of injection interval and/or injection rate of drug. Therefore, it has been difficult to easily control the drug dosage effectively.

Therefore, the present inventor of present invention has developed a soft capsule manufacturing apparatus equipped with an injection controller for controlling an injection amount, an injection interval and/or an injection rate of core solution.

In detail, said injection controller controls an injection amount, an injection interval and/or an injection rate of core solution, using the cyclic movement of piston and the operation of 3-way solenoid valve. Further, the operation of injection controller is automatically adjusted and controlled by control panel, after processing the signal from the detection sensor for checking the injection status.

Problem to be Solved

The problem to be solved is to develop a soft capsule manufacturing apparatus equipped with an efficient injection controller for controlling an injection amount, an injection interval and/or an injection rate of core solution. Further, it is to develop a soft capsule manufacturing apparatus using the movements of piston in the cylinder and the operation of 3-way solenoid valve in an injection controller automatically adjusted and controlled by control panel, after treating the signal from the detection sensor for checking the injection status.

Means for Solving the Problem

The object of the present invention is to provide a soft capsule manufacturing apparatus for controlling the injection of core solution comprising:

1) a gelatin supplying unit comprising a spreader box for discharging melted gelatin, a cooling drum for forming gelatin sheet, a plurality of transfer rollers for transferring gelatin sheets, and 2 die rolls, wherein gelatin sheets are transferred into the center edge for forming the gelatin sheets;

2) a core solution injection unit comprising a hopper for storing and supplying the core solution, an injection controller, an injection wedge segment having injection nozzle, and a driving device for the injection controller comprising a servo motor for producing pivot rotation, a pivot rotation gear for transferring pivot rotation to the piston located on inner part of cylinder;

3) an encapsulation forming unit wherein the core solution injected from the nozzle of injection wedge segment is encapsulated and formed as gelatin soft capsule; and 4) a control panel, wherein said injection controller controls an injection amount, an injection interval and/or an injection rate of core solution, using the cyclic movement of piston and the operation of 3-way solenoid valve, wherein the operation of injection controller is automatically adjusted and controlled by control panel, after processing the signal from the detection sensor for checking the injection status.

Further, said injection controller controls the injection of core solution by repeating the cyclic operation of charging it from the hopper and discharging it to the nozzle of injection wedge segment according to the operation control signal from the control panel, wherein said cyclic operation comprises the steps of:

1) the first step operation of an injection controller combined with a piston in the cylinder, at forward position of piston with up-open status of 3-way valve;

2) the second step operation of an injection controller combined with a piston in the cylinder, at backward position of piston with up-open status of 3-way valve;

3) the third step operation of an injection controller combined with a piston in the cylinder, at backward position of piston with down-open status of 3-way valve; and 4) the fourth step operation of an injection controller combined with a piston in the cylinder, at forward position of piston with down-open status of 3-way valve.

Further, said cyclic operation in injection controller is driven, after converting the pivot rotation movement originated and drived from servo motor into the cyclic piston movement at the entrance of cylinder.

Further, said control panel controls the operation of injection controller, the operation of nozzle in the injection wedge segment, the discharge of melted gelatin from spreader box, the operation of cooling drum and the control of die roll rotation according to the operation signal from control panel, after processing the detection signal from the IR detection sensor for checking the injection status nearby injection wedge segment.

Further, said injection status is an injection amount, an injection interval and/or an injection rate of core solution from the nozzle.

Advantageous Effect

The advantageous effect of present invention is to provide a soft capsule manufacturing apparatus equipped with an efficient injection controller for controlling the injection amount, injection interval and/or injection rate of core solution. Further, said injection controller has to be driven and operated in accordance with movement of piston, for controlling the charging and/or the discharging amount, interval and/or rate of core solution.

PREFERRED EMBODIMENT OF INVENTION

The present invention relates a soft capsule manufacturing apparatus for controlling the injection of core solution comprising: 1) a gelatin supplying unit comprising a spreader box for discharging melted gelatin, a cooling drum for forming gelatin sheet, a plurality of transfer rollers for transferring gelatin sheets, and 2 die rolls, wherein gelatin sheets are transferred into the center edge for forming the gelatin sheets; 2) a core solution injection unit comprising a hopper for storing and supplying the core solution, an injection controller, an injection wedge segment having injection nozzle, and a driving device for the injection controller comprising a servo motor for producing pivot rotation, a pivot rotation gear for transferring pivot rotation to the piston located on inner part of cylinder; 3) an encapsulation forming unit wherein the core solution injected from the nozzle of injection wedge segment is encapsulated and formed as gelatin soft capsule; and 4) a control panel.

Further, said injection controller controls an injection amount, an injection interval and/or an injection rate of core solution, using the cyclic movement of piston and the operation of 3-way solenoid valve, wherein the operation of injection controller is automatically adjusted and controlled by control panel, after processing the signal from the detection sensor for checking the injection status.

The present invention can be explained more specifically with drawings.

Figure 1:
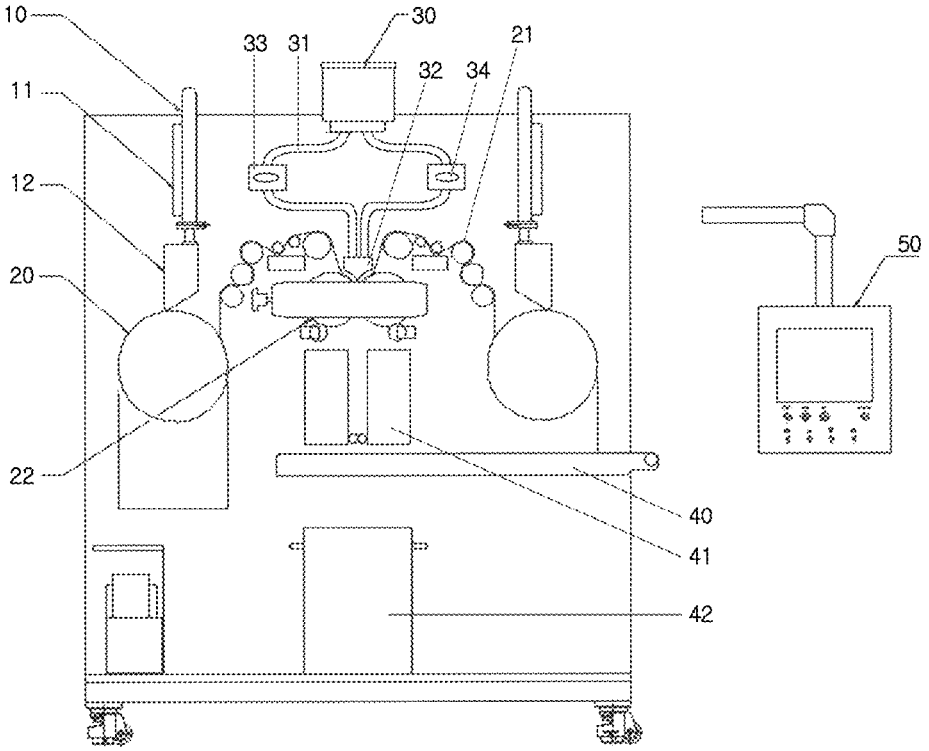
FIG. 1 shows a schematic view of overall structures of soft capsule manufacturing apparatus for controlling the injection of core solution of the present invention.

FIG. 1 shows a schematic view of an overall structure of soft capsule manufacturing apparatus for controlling the injection of core solution of the present invention.

Further, said injection controller can control the injection of core solution, using the movement of piston and the operation of 3-way solenoid valve in the injection controller, which is driven by the power supply and transfer from the servo motor to the piston through the pivot rotation gear.

Further, the operation of injection controller is also controlled according to the operation signal from control panel, after processing the detection signal from the IR detection sensor for checking the injection status nearby injection wedge segment.

As shown in FIG. 1, an overall structure of soft capsule manufacturing apparatus can be explained as follows.

An overall structure of soft capsule manufacturing apparatus of the present invention comprises 4 units, that are, a gelatin supplying unit, a core solution injection unit, an encapsulation forming unit, and a control panel.

A gelatin supplying unit comprises a spreader box (12) for discharging melted gelatin, a cooling drum (20) for forming gelatin sheet, a plurality of transfer rollers (21) for transferring gelatin sheets, and 2 die rolls (22), wherein gelatin sheets are transferred into the center edge for forming the gelatin sheets.

A core solution injection unit comprises a hopper (30) for storing and supplying the core solution, an injection controller (33), an injection wedge segment (32) having injection nozzle (303), and a driving device for the injection controller comprising a servo motor (100) for producing pivot rotation, a pivot rotation gear (102) for transferring pivot rotation to the piston (110) located on inner part of cylinder, and a cylinder (111).

An encapsulation forming unit, wherein the core solution injected from the nozzle of injection wedge segment is encapsulated and formed as gelatin soft capsule.

A control panel (50), wherein said control panel controls the operation of injection controller, the operation of nozzle in the injection wedge segment, the discharge of melted gelatin from spreader box, the operation of cooling drum and the control of die roll rotation according to the operation signal from control panel, after processing the detection signal from the IR detection sensor for checking the injection status nearby injection wedge segment.

Figure 2:
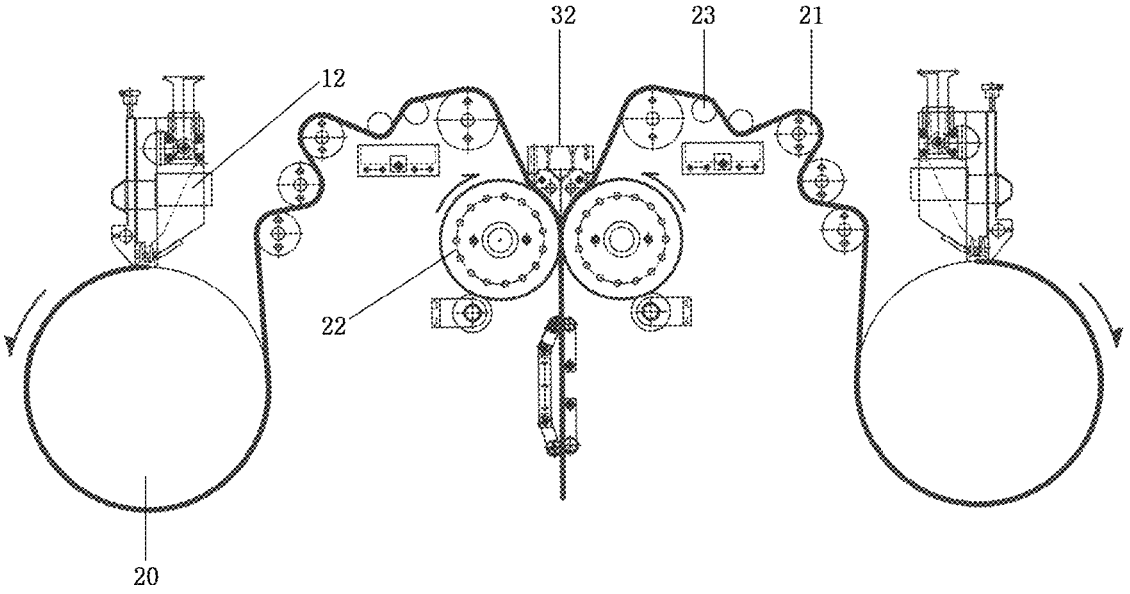
FIG. 2 shows a gelatin supplying unit of soft capsule manufacturing apparatus for controlling the injection of core solution of the present invention. The gelatin sheet is shown as red color.

FIG. 2 shows a gelatin supplying unit of soft capsule manufacturing apparatus for controlling the injection of core solution of the present invention. The gelatin sheet is shown as red color.

As shown in FIG. 2, in a gelatin supplying unit, a gelatin sheet has been formed in the cooling drum after supplying melted gelatin from spreader box. Further, a gelatin sheet has been transferred into the center edge where injection wedge segment and 2 die rolls are crossly intersected.

Figure 3:
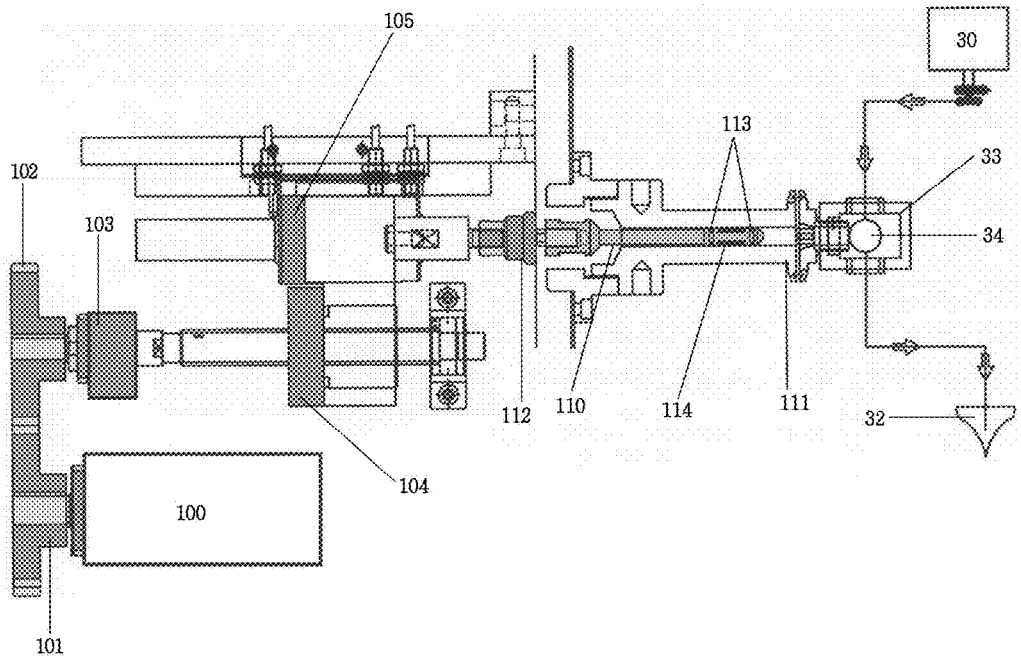
FIG. 3 shows a schematic sectional view of an injection controller combined with a driving device for the injection controller by supplying and transferring power from a servo motor through pivot rotation gear of the present invention.

FIG. 3 shows a schematic sectional view of an injection controller combined with a driving device supplying and transferring power from a servo motor to an injection controller through pivot rotation gear of the present invention.

As shown in FIG. 3, a pivot driving gear (101) is driven according to the pivot movement of servo motor (100). The pivot transfer gear (104) is also driven according to the movement of pivot movement gear (102). Finally, the pivot rotation movement in pivot rotation gear (105) is transferred and converted into the cyclic piston movement in the entrance of cylinder (112).

After converting into cyclic piston movement, the cyclic movement drives the 4 steps of operation of an injection controller and 3-way solenoid valve. The 4 steps of operation of injection controller and 3-way solenoid valve can be explained with drawings as follows.

Figure 4A:
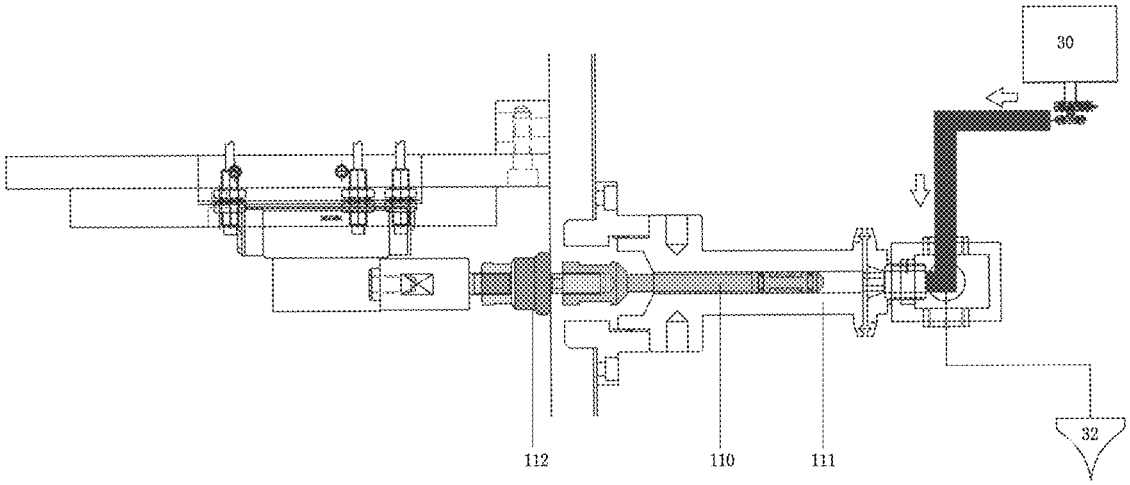
FIG. 4*a* shows the first step operation of an injection controller combined with a piston in the cylinder, at forward position of piston with up-open status of 3-way valve.

FIG. 4*a* shows the first step operation of an injection controller combined with a piston in the cylinder, at forward position of piston with up-open status of 3-way valve.

In the first step, the core solution from the hopper is not charged in the cylinder, while 3-way valve is up open status.

Figure 4B:
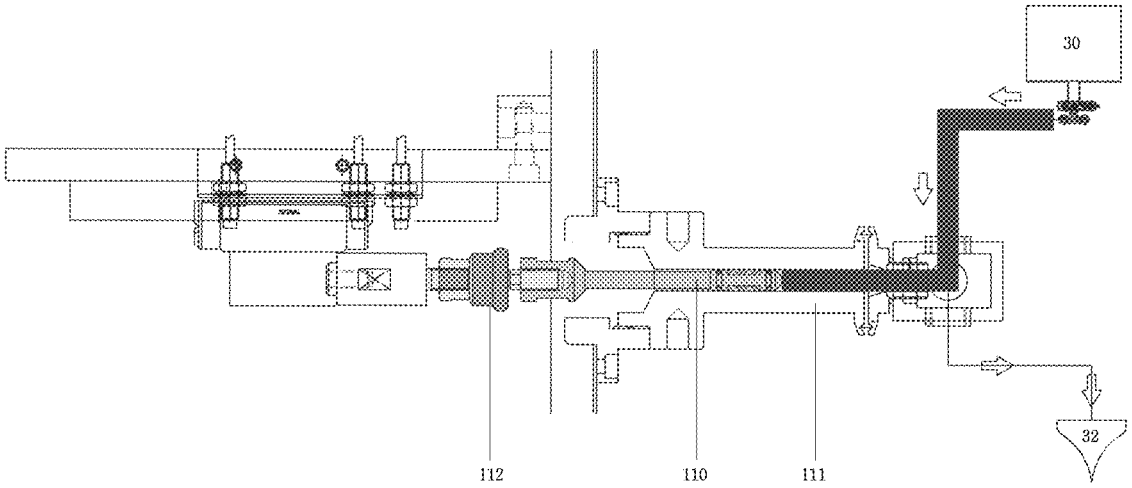
FIG. 4*b* shows the second step operation of an injection controller combined with a piston in the cylinder, at backward position of piston with up-open status of 3-way valve.

FIG. 4*b* shows the second step operation of an injection controller combined with a piston in the cylinder, at backward position of piston with up-open status of 3-way valve.

In the second step, the core solution from the hopper is charged in the cylinder, while 3-way valve is up open status.

Figure 4C:
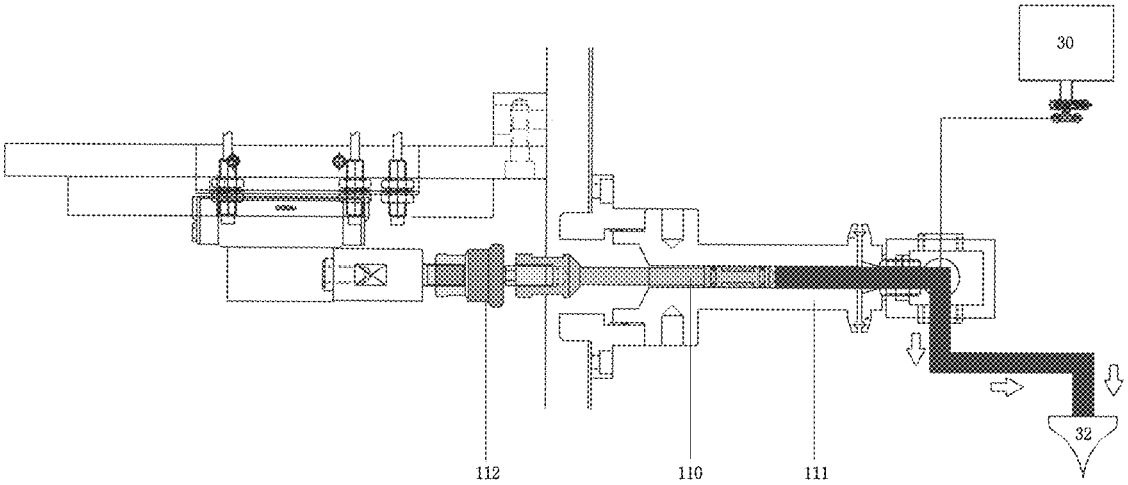
FIG. 4*c* shows the third step operation of an injection controller combined with a piston in the cylinder, at backward position of piston with down-open status of 3-way valve.

FIG. 4*c* shows the third step operation of an injection controller combined with a piston in the cylinder, at backward position of piston with down-open status of 3-way valve.

In the third step, the core solution is not discharged to the nozzle, while 3-way valve is down open status.

Figure 4D:
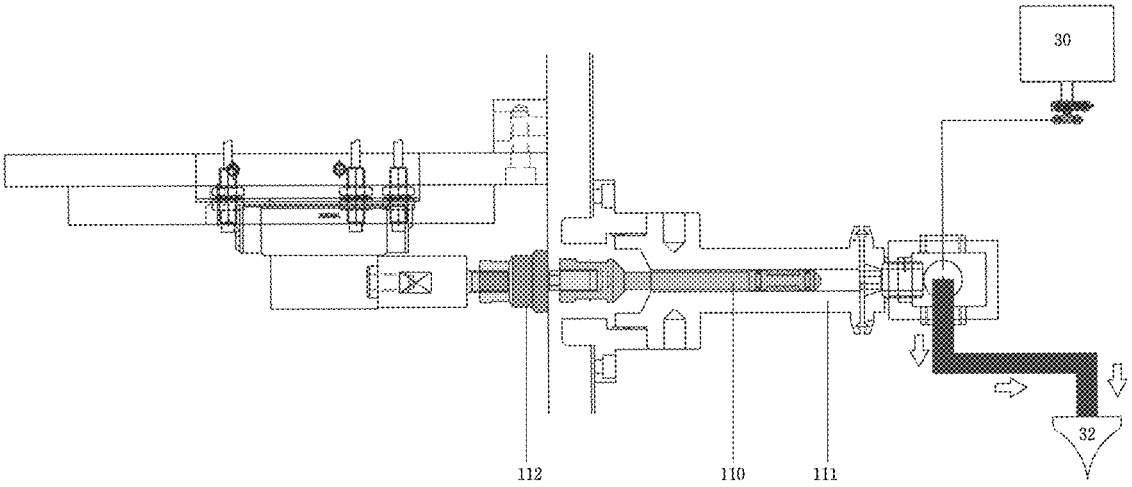
FIG. 4*d* shows the fourth step operation of an injection controller combined with a piston in the cylinder, at forward position of piston with down-open status of 3-way valve.

FIG. 4*d* shows the fourth step operation of an injection controller combined with a piston in the cylinder, at forward position of piston with down-open status of 3-way valve.

In the fourth step, the core solution is discharged to the nozzle, while 3-way valve is down open status.

As shown in FIG. 4, the injection controller controls an injection amount, an injection interval and/or an injection rate of core solution, using the cyclic movement of piston and the operation of 3-way solenoid valve, wherein the operation of injection controller is automatically adjusted and controlled by control panel, after processing the signal from the detection sensor for checking the injection status.

Figure 5:
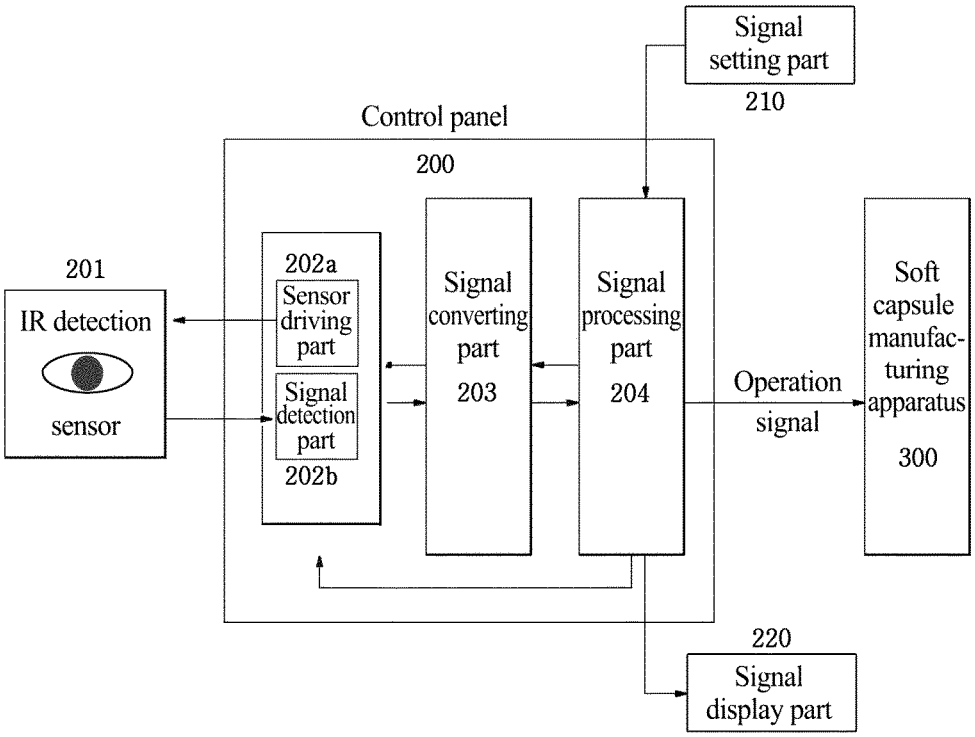
FIG. 5 shows a block diagram indicating the signal processing procedure in the control panel of the present invention.

FIG. 5 shows a block diagram indicating the signal processing procedure in the control panel of the present invention.

As shown in FIG. 5, the signal from sensor driving part (202*a*) is operating the IR detection sensor (201) for detecting the injection status. Then, the detection signal is returned to signal detection part (202*b*). In signal converting part (203), the signal is converted into digital signal. At signal processing part (204), an operation signal for operating the soft capsule manufacturing apparatus (300) of the present invention is driving in accordance with the conditions already set in signal setting part (210).

On the other hand, in signal display part (220), the operation status can be displayed to check the operation conditions of the soft capsule manufacturing apparatus already set by the user.

Figure 6:
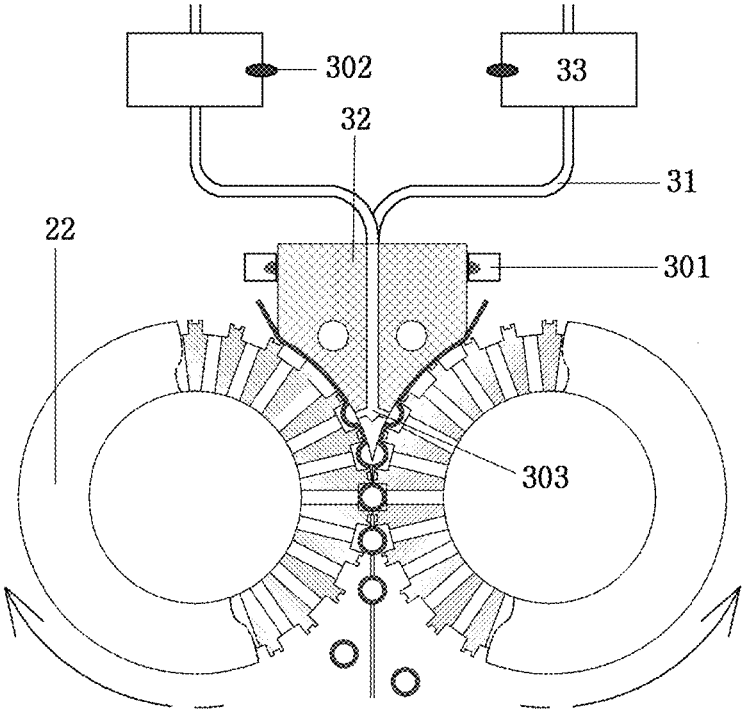
FIG. 6 shows a schematic view of encapsulating a soft capsule with injection control sensor and IR injection detection sensor of the present invention.

FIG. 6 shows a schematic view of encapsulating a soft capsule with injection control sensor and IR injection detection sensor of the present invention.

As shown in FIG. 6, the IR sensor (301) detects an injection amount of core solution, an injection interval and/or an injection rate in the vicinity of the injection wedge segment and transmits the detection signal to the control panel. According to the operation signal processed in control panel, the operation of injection controller, the operation of nozzle in the injection wedge segment, the discharge of melted gelatin from spreader box, the operation of cooling drum and the control of die roll rotation are controlled.

REFERENCE NUMERALS

10: gelatin pipe
11: pipe heater
12: speader box
20: cooling drum
21: transfer roller
22: die roll
30: hopper
31: hose
32: injection wedge segment
33: injection controller
34: 3-way solenoid valve
40: conveyor
41: slope
42: gelatin recovery box
50: control panel
100: servo motor
101: pivot driving gear
102: pivot movement gear
103: pivot transfer gear
104: pivot rotation transfer
105: pivot rotation gear
110: piston
111: cylinder
112: piston cover
113: O-ring
114: wear ring
200: control panel
201: IR detection sensor
202*a*: sensor driving part
202*b*: sensor detection part
203: signal converting part
204: signal processing part
210: signal setting part
220: signal display part
300: soft capsule manufacturing apparatus
301: IR sensor
302: injection operation controller
303: injection nozzle

The invention claimed is:

1. A soft capsule manufacturing apparatus for controlling an injection of core solution comprising:

1) a gelatin supplying unit comprising a spreader box for discharging melted gelatin, a cooling drum for forming gelatin sheets, a plurality of transfer rollers for transferring the gelatin sheets, and two die rolls, wherein the gelatin sheets are transferred into a center edge for forming the gelatin sheets;

2) a core solution injection unit comprising a hopper for storing and supplying the core solution, an injection controller, an injection wedge segment having an injection nozzle, and a driving device for the injection controller comprising a servo motor for producing a pivot rotation, and a pivot rotation gear for transferring the pivot rotation to a piston located on an inner part of a cylinder;

3) an encapsulation forming unit wherein the core solution injected from the nozzle of the injection wedge segment is encapsulated and formed as a gelatin soft capsule; and 4) a control panel, wherein said injection controller controls an injection amount, an injection interval or an injection rate of the core solution, using a cyclic movement of the piston and an operation of a three-way solenoid valve, and wherein an operation of the injection controller is automatically adjusted and controlled by the control panel, after processing a signal from a detection sensor for checking an injection status.

2. The soft capsule manufacturing apparatus for controlling the injection of core solution according to claim 1, wherein said injection controller controls the injection of the core solution by repeating a cyclic operation of charging the core solution from the hopper and discharging the core solution to the nozzle of the injection wedge segment according to an operation control signal from the control panel, wherein said cyclic operation comprises the steps of:

1) a first step operation for the injection controller combining the piston in the cylinder at a forward position with an up-open status of the three-way solenoid valve;

2) a second step operation for the injection controller combining the piston in the cylinder at a backward position with the up-open status of the three-way solenoid valve;

3) a third step operation for the injection controller combining the piston in the cylinder at the backward position with a down-open status of the three-way solenoid valve; and 4) a fourth step operation for the injection controller combining the piston in the cylinder at the forward position with the down-open status of the three-way solenoid valve.

3. The soft capsule manufacturing apparatus for controlling the injection of core solution according to claim 2, wherein said cyclic operation for the injection controller is driven by converting a pivot rotation movement originated and driven by the servo motor into a cyclic piston movement at an entrance of the cylinder.

4. The soft capsule manufacturing apparatus for controlling the injection of core solution according to claim 1, wherein said control panel controls the operation of the injection controller, an operation of the injection nozzle of the injection wedge segment, the discharge of the melted gelatin from the spreader box, an operation of the cooling drum, and rotation of the two die rolls according to one or more operation signals from the control panel, after processing the signal from the detection sensor for checking the injection status.

5. The soft capsule manufacturing apparatus for controlling the injection of core solution according to claim 4, wherein said injection status comprises one or more of the injection amount, the injection interval or the injection rate of the core solution from the injection nozzle.

* * * * *